US007980387B2

(12) United States Patent
Allen et al.

(10) Patent No.: US 7,980,387 B2
(45) Date of Patent: Jul. 19, 2011

(54) TELESCOPING CASE

(75) Inventors: James William Allen, Nazareth, PA (US); Robert Henry, Bethlehem, PA (US); Pam Dozier, Doylestown, PA (US); Cara Skrips, Blairstown, NJ (US)

(73) Assignee: Crayola LLC, Easton, PA (US)

( * ) Notice: Subject to any disclaimer, the term of this patent is extended or adjusted under 35 U.S.C. 154(b) by 388 days.

(21) Appl. No.: 12/039,462

(22) Filed: Feb. 28, 2008

(65) Prior Publication Data

US 2009/0218240 A1 Sep. 3, 2009

(51) Int. Cl.

| | |
|---|---|
| ***A45C 11/34*** | (2006.01) |
| ***A47F 7/00*** | (2006.01) |
| ***B65D 8/14*** | (2006.01) |

(52) U.S. Cl. ..... 206/214; 220/8; 211/69.1; 211/70

(58) Field of Classification Search ..... 206/214, 206/15.2, 15.3, 218; 220/694, 8, 525, 810; 211/70, 69.1

See application file for complete search history.

(56) References Cited

U.S. PATENT DOCUMENTS

| | | | | | |
|---|---|---|---|---|---|
| 2,496,758 | A * | 2/1950 | Tingley | 47/41.13 |
| 3,715,996 | A * | 2/1973 | Rolfshus | 297/311 |
| 4,534,474 | A * | 8/1985 | Ng | 211/70 |
| 4,973,189 | A * | 11/1990 | Bechtold | 404/6 |
| 4,978,021 | A * | 12/1990 | Mini et al. | 220/8 |
| D325,934 | S * | 5/1992 | Ramljak | D19/85 |
| 5,190,151 | A * | 3/1993 | Dietterich | 206/214 |
| 5,562,518 | A * | 10/1996 | Estrada | 446/5 |
| 5,862,932 | A * | 1/1999 | Walsh et al. | 220/8 |
| 6,666,329 | B1 * | 12/2003 | Charbonneau | 206/218 |
| 7,617,927 | B1 * | 11/2009 | Smith, Jr. | 206/15.3 |
| 2006/0261017 | A1 * | 11/2006 | Yoon | 211/69.1 |
| 2009/0013566 | A1 * | 1/2009 | Cetera | 40/124.06 |

* cited by examiner

*Primary Examiner* — J. Gregory Pickett
*Assistant Examiner* — Ernesto A Grano
(74) *Attorney, Agent, or Firm* — Shook, Hardy & Bacon L.L.P.

(57) ABSTRACT

An expandable storage case is disclosed for storing various writing utensils. The storage case includes a base, an inner carousel, a top carousel, and a lid. The base, the inner carousel, and the top carousel are connected in a telescoping manner such that the storage case may be expanded from a collapsed position to an expanded, in-use position. The storage case includes a locking mechanism to selectively secure the storage case in the expanded position.

7 Claims, 5 Drawing Sheets

TELESCOPING CASE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to a storage case for carrying writing implements. More specifically, the invention relates to an expandable storage case that carries writing implements.

Storage cases for writing implements are know in the art and come in many forms. A typical crayon case is made of cardboard and includes a flip-top and multiple storage containers. The storage containers are used to collect and display the crayons. However, the construction of the container from cardboard material provides a container that is not durable. Another type of case is a plastic hinged case, similar to a lunch box wherein writing implements may be placed.

BRIEF SUMMARY OF THE INVENTION

Accordingly, the present invention provides an improved storage case for writing implements that may house various sizes in multiple compartments based on user preference.

The storage case includes a base, an inner carousel, a top carousel, and a lid. The base, the inner carousel, and the top carousel are connected in a telescoping manner such that the storage case may be expanded when in use. The base contains a floor, an outer wall, and an inner wall. The inner wall is cylindrical, located radially inwardly and spaced apart from the outer wall, and interconnected therewith by a plurality of partitions. The partitions along with the walls combine to create a plurality of separated storage spaces that receive the writing utensils. The inner wall contains an inner surface with a plurality of elongate guides.

The inner carousel comprises a floor with a plurality of notches and a wall. The notches are aligned with and receive the elongate guides on the inner surface of the inner wall. The inner wall further contains a plurality of projections that extend outwardly towards the inner surface of the inner wall of the base to create a plurality of separated storage spaces therebetween. The inner surface of the wall also contains a plurality of elongate guides that depend inwardly from the inner surface and extend upwardly from the floor.

The top carousel comprises a floor with a plurality of notches and a divider. The notches in the floor are aligned with and receive the elongate guides on the inner surface of the wall. As such, the guides and the notches serve to allow the inner carousel to slide in a telescoping manner with respect to the base and the top carousel to slide in a telescoping manner with respect to the inner carousel. The lid is rotatably coupled to the divider of the top carousel.

Further, the case also contains a lock-stop assembly having a divider and a locking mechanism. The dividers are located on the inner surface of the inner wall of the base and the inner surface of the wall of the inner carousel and each project inwardly therefrom. The locking mechanisms are located on the floors of the inner and top carousels. The locking mechanisms are used to lock the inner carousel with respect to the base and the top carousel with respect to the inner carousel when the storage case is expanded.

As such, in use, the user rotates the lid upwardly and then pulls in a vertical direction. The guides of the notches cooperate to move the inner and top carousels upwardly with respect to the base and inner carousel respectively. The locking mechanisms lock the inner carousel with respect to the base and the top carousel with respect to the inner carousel when the storage case is expanded.

Additional advantages and novel features of the invention will be set forth in part in a description which follows, and in part will become apparent to those skilled in the art upon examination of the following, or may be learned by practice of the invention.

BRIEF DESCRIPTION OF THE SEVERAL VIEWS OF THE DRAWING

In the accompanying drawings which form a part of the specification and which are to be read in conjunction therewith, and in which like reference numerals are used to indicate like parts in the various views.

DETAILED DESCRIPTION OF THE INVENTION

Figure 1:
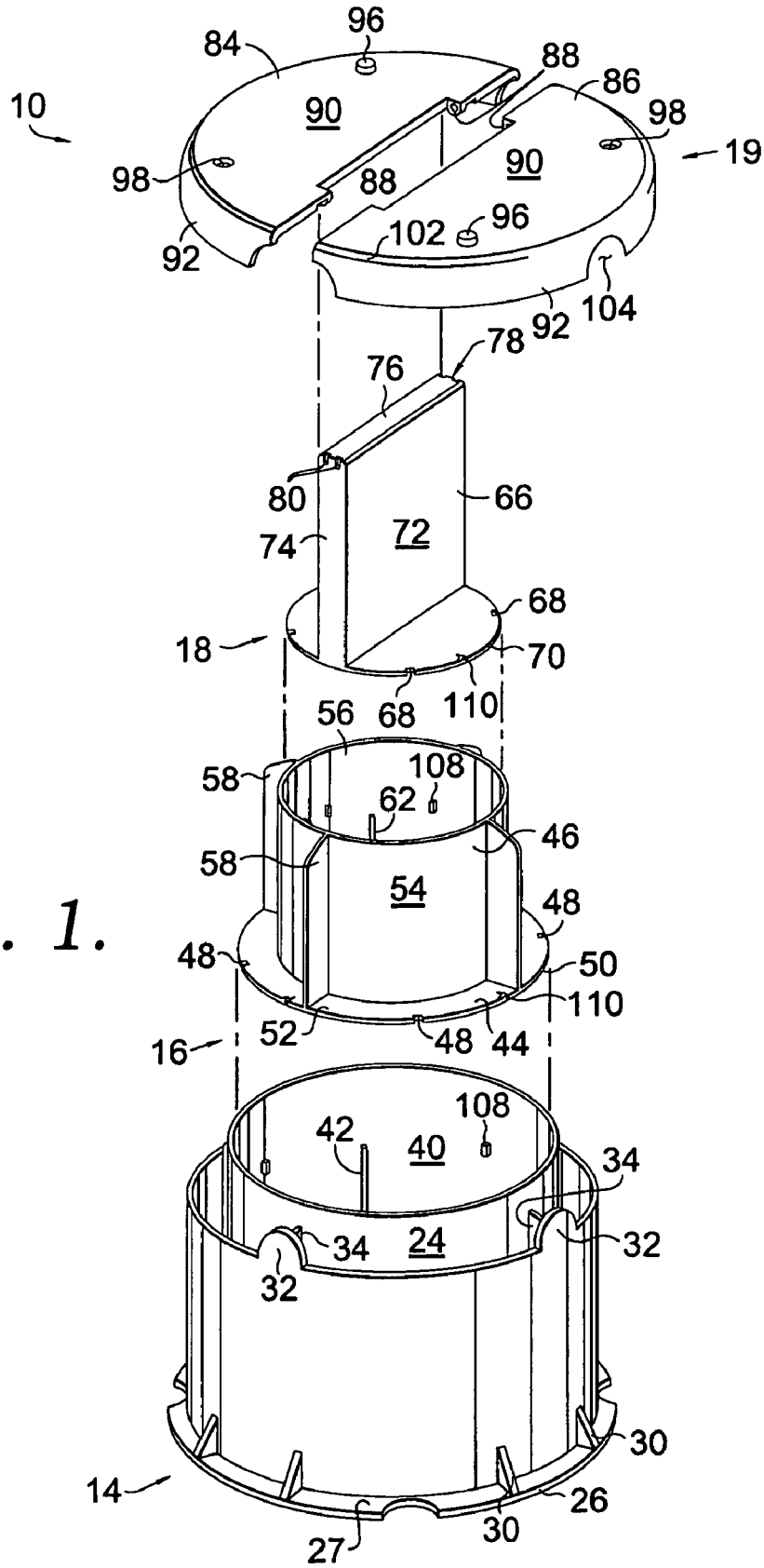
FIG. 1 is an exploded view of a case.
Figure 2:
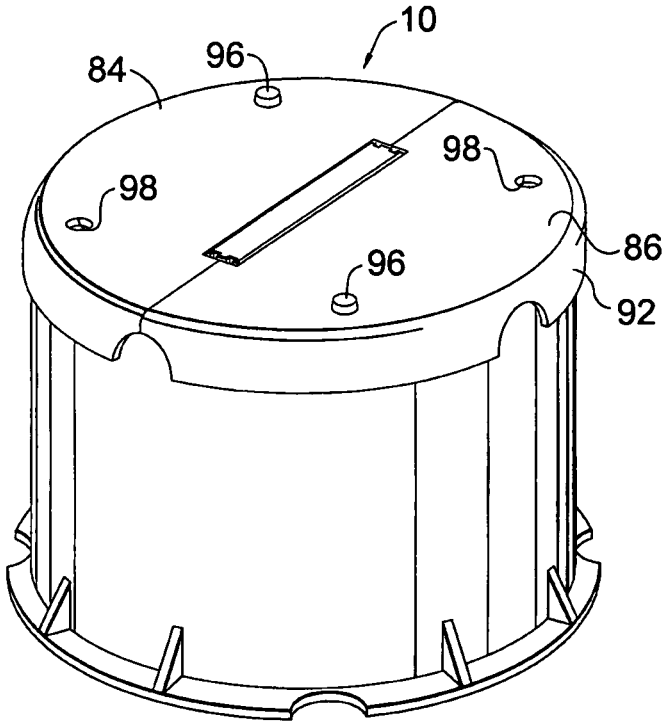
FIG. 2 is a perspective view of the case in the collapsed position.
Figure 3:
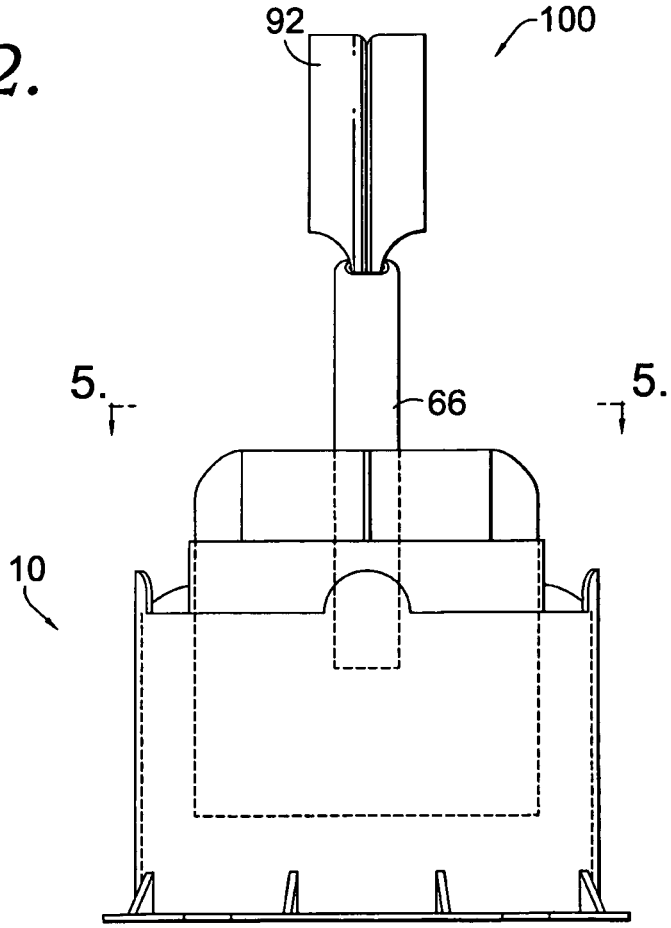
FIG. 3 is a front elevation view of the case in the expanded position.
Figure 4:
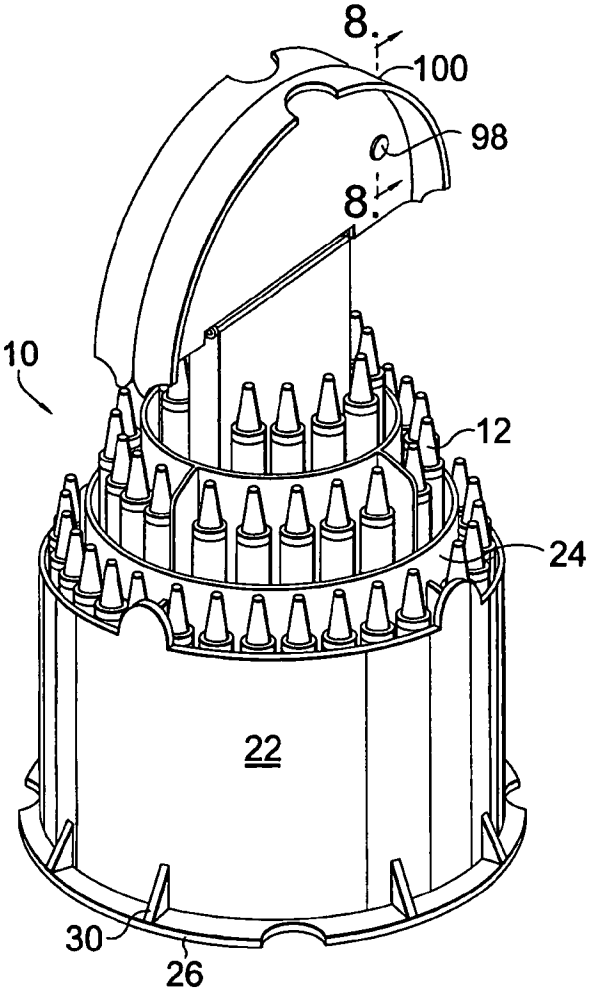
FIG. 4 is a perspective view of the case in the expanded position.

Referring to the drawings in greater detail and initially to FIGS. 1 and 2, a storage case is shown and designated generally by the numeral 10. The storage case 10 is used to store various writing utensils 12, including but not limited to crayons, pens, pencils or markers. The storage case 10 includes a base 14, an inner carousel 16, a top carousel 18, and a lid 19, each of which are preferably made from molded plastic. As will be further described the base 14, the inner carousel 16, and the top carousel 18 are connected in a telescoping manner such that the storage case may be expanded when in use. Specifically, FIG. 2 shows the storage case 10 in the collapsed position. FIG. 4 shows the storage case in an expanded position and filled with crayons 12. FIG. 3 shows the storage case 10 in the expanded position, with hidden lines that show the orientation of the inner carousel 16 and the top carousel 18.

Figure 5:
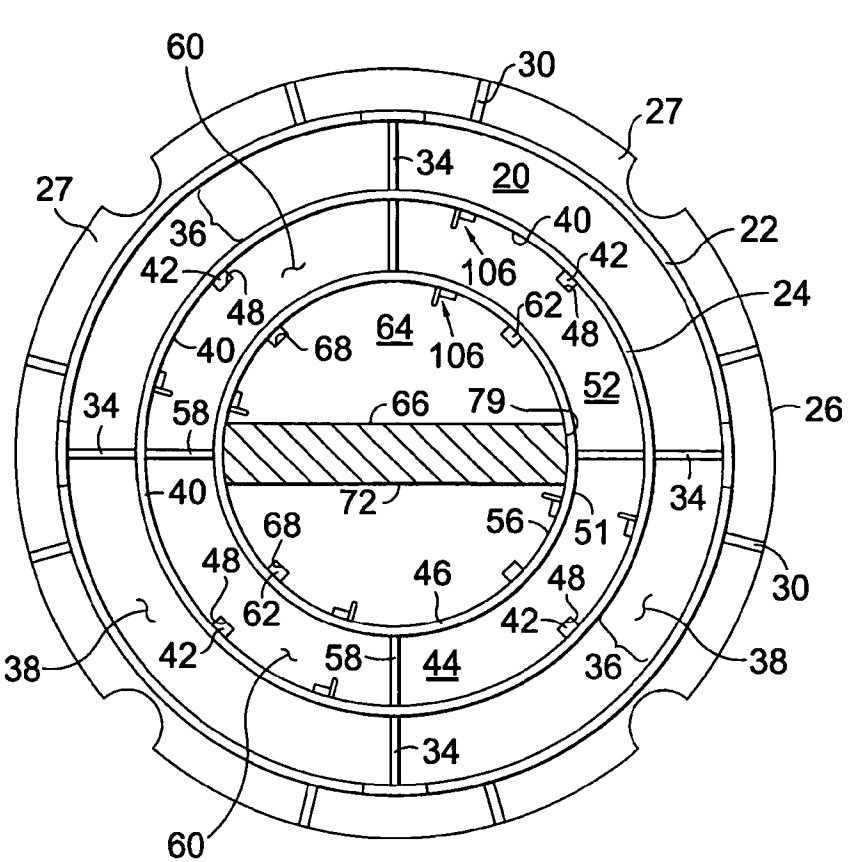
FIG. 5 is a top plan view of the case of FIG. 4 with the lid removed.

Referring now to FIGS. 1 and 5, the base 14 contains a floor 20, an outer wall 22, and an inner wall 24. The floor 20 is generally circular and contains a perimeter 26 with a plurality of recesses 28. The outer wall 22 is cylindrical, located inwardly from the perimeter 26 of the floor 20, and extends upwardly therefrom. Specifically, the outer wall 22 extends upwardly generally perpendicularly from the floor 20. The radially inward location of the outer wall 22 creates a flange 27 extending outwardly from the outer wall 22. The flange 27 is supported and connected to a lower portion of the outer wall 22 by a plurality of supports 30. The upper perimetry of outer wall 22 contains a plurality of upwardly depending tabs 32.

The inner wall 24 is cylindrical, located radially inward and spaced apart from the outer wall 22 creating a channel 36 therebetween. The inner wall 24 extends upwardly from the floor 20 at generally a 90° angle and is oriented generally parallel to the outer wall 22. The inner wall 24 is connected to the outer wall 22 by a plurality of partitions 34 that extend therebetween. The channel 36 when combined with the partitions 34 create separated storage spaces that receive the writing utensils 12. The inner wall 24 further contains an inner surface 40 having a plurality of elongate guides 42. The guides 42 are protrusions that depend inwardly from the inner surface 40 of the inner wall 24 and extend upwardly from the base 14.

Figure 6:
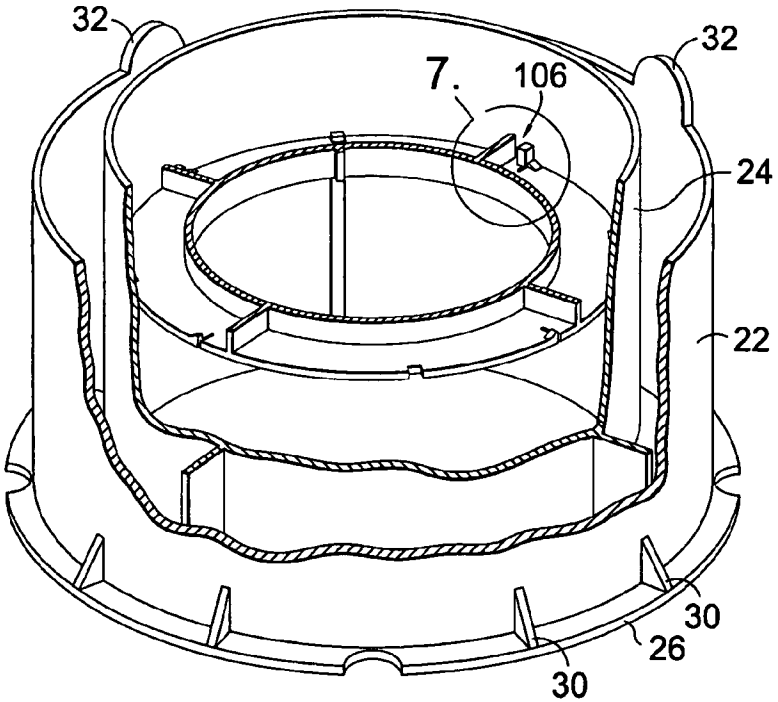
FIG. 6 is a partial, perspective view of the case with parts removed showing the internal configuration of the case.

Referring now to FIGS. 1, 5, and 6, the inner carousel 16 contains a floor 44 and a substantially upright wall 46. The floor 44 is generally circular and contains a plurality of notches 48 at its perimeter 50. The notches 48 are operably configured to be aligned with and receive the elongate guides 42. As such, the guides 42 and the notches 48 serve to allow the inner carousel 16 to slide in a telescoping manner with respect to the base 14. The wall 46 is generally cylindrical and is located radially inward from the perimeter 50 of the floor 44 and extends upwardly therefrom. Specifically, the wall 46 extends upwardly from the floor 44 at generally a 90° angle and is oriented in a parallel relationship with the inner and outer walls 24, 22 of the base 14. The inward location of the wall 46 creates a carousel flange 52 that extends outwardly from the wall 46. The wall 46 further includes projections 58 extending radially outwardly from an outer surface 54 of the wall 46 towards the inner surface 40 of the inner wall 24 of the base 14. The projections 58 along with wall 46 of the inner carousel 16 and the inner wall 24 of the base 14, define separated storage spaces 60 therebetween. An inner surface 56 of the wall 46 further contains a plurality of elongate guides 62 that depend radially inwardly from the inner surface 56 and extend upwardly from the floor 44.

Referring now to FIGS. 1 and 3-5, the top carousel 18 contains a floor 64 and a divider 66. The floor 64 is generally circular and contains a plurality of notches 68 at its perimeter 70. The notches 68 in the floor 64 are operably configured to be aligned with and receive the elongate guides 62 of wall 46. As such, the guides 62 and the notches 68 allow the top carousel 18 to slide in a telescoping manner with respect to the inner carousel 16. The divider 66 extends upwardly from the floor 64 and has a pair of side walls 72, a pair of end walls 74, and a top wall 76. The top wall 76 connects the side and end walls 72, 74 and contains an attachment portion 78. The attachment portion 78 includes a pair of recesses 80 that are located on the top wall 76 proximate the end walls. The recesses 80 are used to couple the lid 19 to the divider 66 as will be discussed further below.

Referring now to FIGS. 1-3, and 8, the lid 19 contains a pair of covers 84, 86. The covers 84, 86 contain an attachment member 88, a semi-circular upper surface 90, and a downwardly depending lip 92. The attachment member 88 of the cover portions 84, 86 is ratably coupled with the recesses 80 of the attachment portion of the top wall 76. As such the cover portions 84, 86 may be rotated upwardly to expose the writing implements 12 in the storage spaces.

Figure 8:
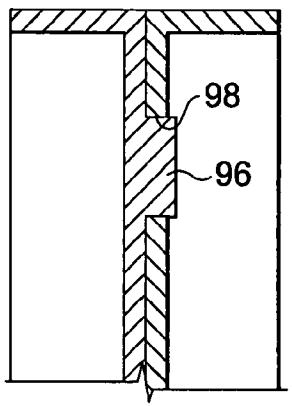
FIG. 8 is a cross-sectional view of the recess and projection in the lid of the case, taken along the line 8-8.

The surface 90 of each cover portion 84, 86 contains a projection 96 and a recess 98. It should be understood that the projection 96 and recess 98 on each cover portion 84, 86 are operably configured to be aligned to allow the cover portions 84, 86 to be coupled together when the cover portions 84, 86 are rotated upwardly. Specifically, as seen in FIGS. 4 and 8, the projections 96 are received within the recesses 98 in a frictional fit to releasably secure the cover portions 84, 86 to one another when the cover portions 84, 86 are rotated upwardly. The cover portions 84, 86, as coupled together, form a handle 100, the purpose of which will be described fully below. Referring again to FIGS. 1 and 2, the lips 92 of the cover portions contain a plurality of recesses 104 that are oriented in a similar manner as the tabs 32 on the outer wall 22.

Figure 7:
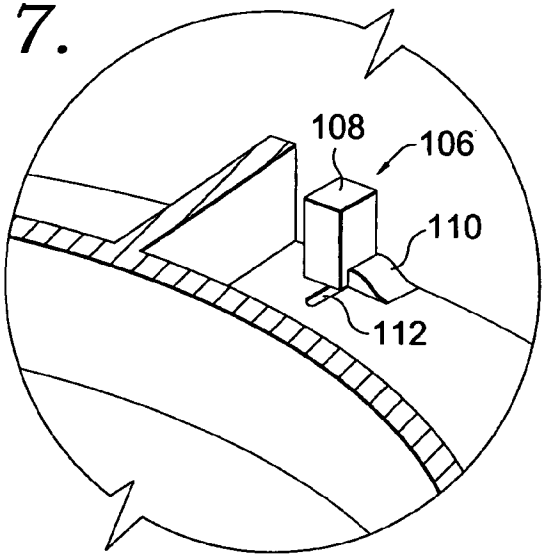
FIG. 7 is a partial, enlarged, perspective view of the lock-stop assembly, shown in FIG. 6.

As seen in FIGS. 5-7, the storage case 10 further comprises a lock-stop assembly 106. The lock-stop assembly 106 includes a divider 108 and a locking mechanism 110. The dividers 108 are located on the inner surface 40 of the inner wall 24 of the base 14 and the inner surface 56 of the wall 46 of the inner carousel 16, and each project inwardly therefrom. It should be understood that multiple tabs 108 are located on both the inner wall 24 of the base 14 and the inner surface 56 of the wall 46 of the inner carousel 16 and the number of tabs 108 correspond to the number of locking mechanisms 110. The locking mechanisms 110 are located on the flange 52 of the inner carousel 16 and the floor 64 of the top carousel 18. Each locking mechanism 110 contains a slot 112 that is operably configured to receive the tab 108 to lock the inner carousel 16 with respect to the base 14 and the top carousel 18 with respect to the inner carousel 16 when the storage case is expanded.

The storage case 10 is shown in a collapsed position in FIG. 2 and an expanded position in FIGS. 3 and 4. In operation, the user moves the storage case 10 from the collapsed position to the expanded position by first rotating the cover portions 84, 86 upwardly and coupling them to one another to form the handle 100. Next, the user pulls upwardly on the handle 100 to move the storage case from the collapsed position of FIG. 2 to the expanded position of FIG. 3. As seen in FIG. 5, the guides 42, 62 and the notches 48, 68 serve to guide the inner and top carousels 16, 18. Once in the expanded position, as shown in FIGS. 5-7, tabs 108 are received in the slots 112 to lock the inner carousel 16 with respect to the base 14 and the top carousel 18 with respect to the inner carousel 16. To return the storage case 10 to the collapsed position the user simply applies a downward pressure thereby causing the lock-stop assembly 106 to unlock and the inner and top carousels 16, 18 to return to the collapsed position. It should be understood that the floor 64 of the top carousel 18 contacts the floor 44 of the inner carousel 16, which, in turn contacts the floor 20 of the base 14 when the storage case 10 is in the collapsed position.

Figure 9:
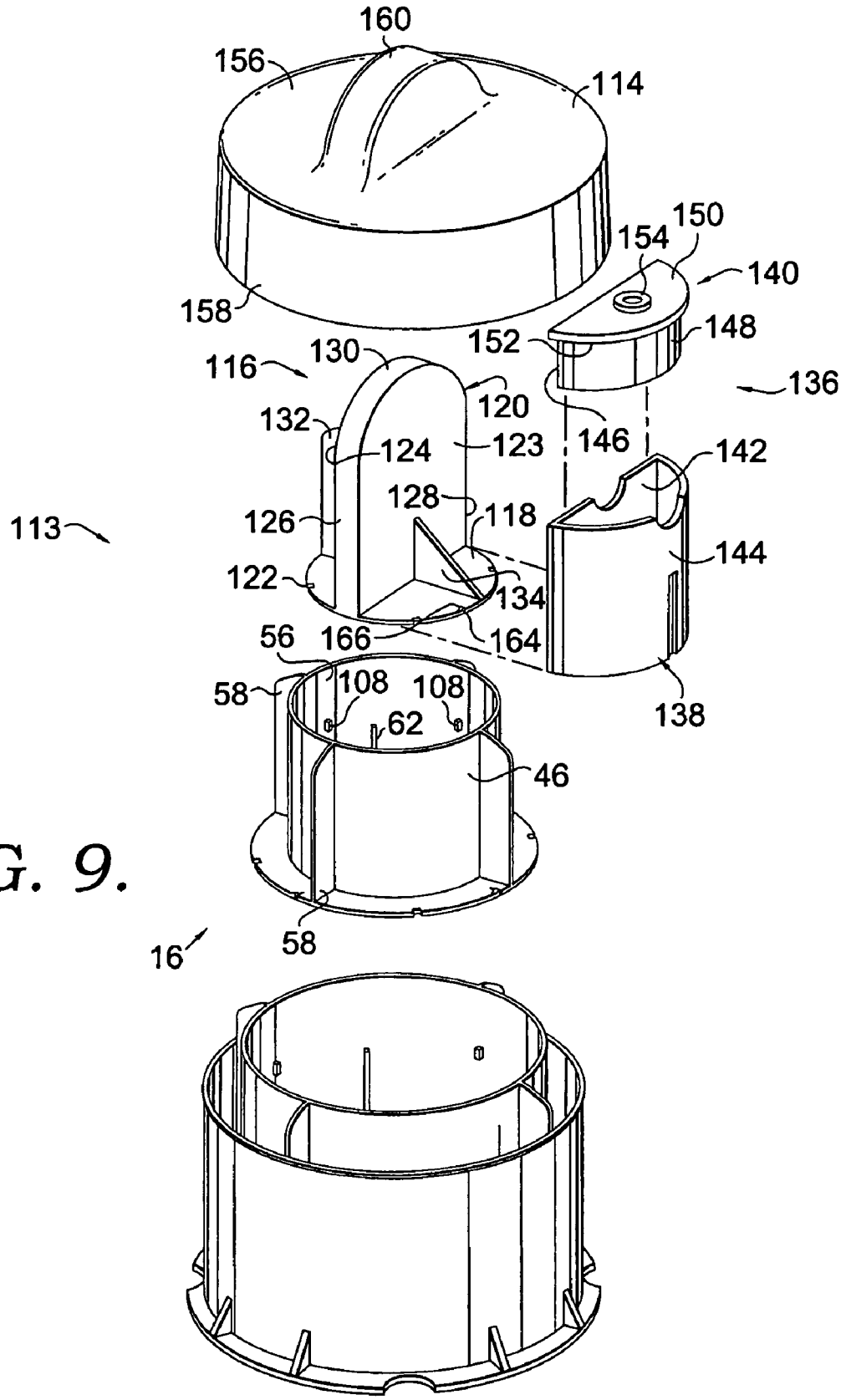
FIG. 9 is an additional embodiment of an exploded view of a case.

FIG. 9 shows an additional embodiment of a storage case 113 of the present invention. All of the elements are the same as the previous embodiment shown in FIGS. 1-8 with the exception of the lid 114 and top carousel 116. Specifically, the top carousel 116 contains a floor 118 and an arcuate divider 120. The floor 118 is generally circular and contains a plurality of notches 122 at its perimeter. The notches 122 in the floor 118 are aligned with and receive the elongate guides 62 on the inner surface 56 of the inner carousel 16. As such, the guides 62 and the notches 122 serve to allow the top carousel 116 to slide in a telescoping manner with respect to the inner carousel 16. The divider 120 contains a pair of side walls 123, 124, a pair of end walls 126, 128, and an arcuate top wall 130. The side wall, 123, 124 and end walls 126, 128 each extend upwardly from the floor 118. The top wall 130 connects the side and end walls 123, 124 and 126, 128. The top carousel 116 further includes a projection 132 and a support guide 134. The projection 132 extends outwardly and upwardly from the floor 118 and the side wall 124. As such, the projection 132 along with the wall 46 of the inner carousel 16 provide a storage compartment therebetween. The support guide 134 is mounted to floor 118 and the side wall 123 and depends diagonally from the floor 118 to the side wall 123.

The top carousel 116 further contains a pencil sharpener assembly 136 having a cup 138 and a sharpening insert 140. The cup 138 is semi-circular in cross-section and includes an inner wall 142 and outer arcuate wall 144. The cup 138 fits between the sidewall 123 of the divider 120 and the wall 46 of the inner carousel 16. Specifically, the inner wall 142 abuts the sidewall 123 of the divider 120 and the outer wall 144 abuts the inner surface 56 of the wall 46 of the inner carousel 16. The cup 138 collects the pencil shavings when a pencil is sharpened. The sharpening insert 140 contains an inner wall 146, an outer arcuate wall 148, and a top shelf 150. The inner wall 146 and outer wall 148 are interconnected, sized, and operably configured to fit within the cup 138. The top shelf 150 provides a flange 152 that allows the sharpening insert 140 to sit on top of the cup 138. The sharpener 154 is received within an aperture, not shown, in the sharpening insert 140.

The lid 114 is generally circular and has a top surface 156, a sidewall 158, and a grip 160. The grip 160 is arcuate and depends upwardly from the top surface 156. The sidewall 158 depends downwardly from the perimeter of top surface 156.

The top carousel 116 also includes a lock-stop assembly 162, each having a divider 108, and a locking mechanism 164. The dividers 108 are located on the inner surface 56 of the wall 46 of the inner carousel 16 and project inwardly therefrom. It should be understood that multiple tabs 108 are located on the inner surface 56 of the wall 46 of the inner carousel 16 and the number of tabs 108 correspond to the number of locking mechanisms 164. The locking mechanisms 164 are located on the floor 118 of the top carousel 116. The locking mechanisms 164 contain a slot 168 that receives the tab 108 to lock the top carousel 116 with respect to the inner carousel 16 when the storage case is expanded.

The operation of the additional embodiment of the storage case 113 is similar to that of the storage case 10. First the user simply lifts off the lid 114. Next, the user pulls upwardly on the divide 120 to move the storage case from the collapsed position to the expanded position. The notches, guides, and locking members work the same as previously described above.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. A case for storing a plurality of writing implements, the case comprising:

a base having a floor with a cylindrical wall depending upwardly therefrom;

an inner carousel having a floor with a cylindrical wall depending upwardly therefrom, the inner carousel being operably configured to be slidably received within the base and slideably and telescopically movable from a first storage position to a second expanded position, wherein the inner carousel and the base maintain a slideable engagement formed by a guide on an inner surface of the cylindrical wall of the base and a notch in an outer perimeter of the floor of the inner carousel;

a top carousel having a floor and a block member extending upwardly therefrom, the top carousel operably configured to be slidably received within the inner carousel, and movable from a first storage position to a second expanded position, the top carousel including a lid having a pair of covers that are rotatably mounted to the block member at an end opposite to the floor and the lid being slidably received on the cylindrical wall of the base; and a lock-stop mechanism, the lock-stop mechanism being adapted to lock the inner carousel with respect to the base when the inner carousel is in the second expanded position.

2. The case of claim 1, wherein the top carousel further comprises a second lock-stop mechanism, the second lock-stop mechanism being operably configured to lock the top carousel with respect to the inner carousel when the top carousel is in the second position.

3. The case of claim 2, wherein the lock-stop mechanism includes at least one tab and at least one locking mechanism.

4. The case of claim 3. wherein the at least one tab is located on an inner surface of the cylindrical walls of the base and the inner carousel.

5. The case of claim 4, wherein the at least one locking mechanism is located on the floors of the base and inner carousel.

6. The case of claim 5, wherein the at least one tab includes a plurality of tabs and the at least one locking mechanism includes a plurality of locking mechanisms.

7. A container for storing writing implements, the container comprising:

a base having a floor and a cylindrical wall extending upwardly therefrom;

an inner container having a floor with a cylindrical wall depending upwardly therefrom, the inner container being telescopically mounted to the base, the inner container being movable from a first storage position to a second extended position;

a top carousel having a floor and a block member extending upwardly therefrom, the top carousel being slidably coupled with the inner carousel, and the top carousel being movable from a first storage position to a second extended position;

a lid coupled to the top carousel, the lid having a pair of covers that are rotatably mounted to the block member at an end opposite to the floor and the lid being slidably received on the cylindrical wall of the base, wherein the pair of covers are upwardly rotatable to a position parallel to one another to form a handle; and a pair of lock-stop mechanisms, a first lock-stop mechanism being operably configured to lock the inner container with respect to the base and a second lock-stop mechanism configured to lock the top carousel with respect to the inner container when the inner carousel and top carousel are in the second extended position; wherein the first and second lock-stop mechanisms include at least one tab and at least one locking mechanism wherein the at least one tab is located on an inner surface of the cylindrical walls of the base and the inner container and wherein the at least one locking mechanism is located on the floors of the base and inner container.

* * * * *